US009206808B2

(12) United States Patent
Yuan

(10) Patent No.: US 9,206,808 B2
(45) Date of Patent: Dec. 8, 2015

(54) FAN BLADE SYSTEM WITH MULTIPLE SPACED LAYERS OF BLADES AND CENTRIFUGAL FAN USING SAME

(71) Applicant: Asia Vital Components (China) Co., Ltd., Shenzhen (CN)

(72) Inventor: Meihua Yuan, Shenzhen (CN)

(73) Assignee: Asia Vital Components (China) Co., Ltd., Shenzhen (CN)

( * ) Notice: Subject to any disclaimer, the term of this patent is extended or adjusted under 35 U.S.C. 154(b) by 540 days.

(21) Appl. No.: 13/647,634

(22) Filed: Oct. 9, 2012

(65) Prior Publication Data

US 2014/0099207 A1 Apr. 10, 2014

(51) Int. Cl.

| | |
|---|---|
| ***F01D 1/24*** | (2006.01) |
| ***F04D 25/06*** | (2006.01) |
| ***F04D 25/16*** | (2006.01) |

(52) U.S. Cl.

CPC ..... *F04D 25/064* (2013.01); *F04D 25/166* (2013.01)

(58) Field of Classification Search

CPC ... F04D 19/007; F04D 19/022; F04D 25/064; F04D 25/166; F04D 29/181; F04D 29/325; F04D 29/327; F04D 29/328; F04D 29/522

See application file for complete search history.

(56) References Cited

U.S. PATENT DOCUMENTS

| | | | | |
|---|---|---|---|---|
| 3,241,493 | A * | 3/1966 | Frey | 415/191 |
| 4,502,837 | A * | 3/1985 | Blair et al. | 415/198.1 |
| 6,179,561 | B1 * | 1/2001 | Horng | 415/208.3 |
| 6,511,300 | B2 * | 1/2003 | Otsuka | 417/354 |
| 6,540,479 | B2 * | 4/2003 | Liao et al. | 415/199.5 |
| 6,572,336 | B2 * | 6/2003 | Horng et al. | 416/183 |
| 6,648,602 | B2 * | 11/2003 | Horng et al. | 416/203 |
| 6,832,895 | B2 * | 12/2004 | Yoshioka et al. | 416/183 |
| 7,008,180 | B2 * | 3/2006 | Fujimori et al. | 415/121.2 |
| 7,083,386 | B2 * | 8/2006 | Horng et al. | 416/175 |
| 7,182,572 | B2 * | 2/2007 | Yang | 415/175 |
| 7,241,110 | B2 * | 7/2007 | Chang et al. | 415/184 |

* cited by examiner

*Primary Examiner* — Igor Kershteyn

(74) *Attorney, Agent, or Firm* — C. G. Mersereau; Nikolai & Mersereau, P.A.

(57) ABSTRACT

A fan blade system with multiple spaced layers of blades and a centrifugal fan using same are disclosed. The centrifugal fan includes a housing, in which the fan blade system is mounted. The fan blade system includes a hub, and a first and a second blade group outward extended from a circumferential wall of the hub to axially space from each other. The housing includes a main housing portion and a secondary housing portion integrally formed on one side of the main housing portion. When the fan blade system is mounted in the housing, the two blade groups are separately located in the main housing portion and the secondary housing portion to produce higher airflow pressure and more air volume. With these arrangements, the centrifugal fan can have upgraded performance and be manufactured with reduced labor, time and material costs.

15 Claims, 9 Drawing Sheets

FAN BLADE SYSTEM WITH MULTIPLE SPACED LAYERS OF BLADES AND CENTRIFUGAL FAN USING SAME

FIELD OF THE INVENTION

The present invention relates to a fan blade system and a centrifugal fan using same; and more particularly to a fan blade system with multiple spaced layers of blades that enables a centrifugal fan using same to have upgraded performance and be manufactured with reduced labor, time and material costs.

BACKGROUND OF THE INVENTION

Most of the currently available electronic devices, such as the notebook computers, are quickly developed to have high performance, high frequency, high operating speed and highly slim configuration. However, electronic devices with these features tend to produce more and more heat during operation thereof and are therefore subjected to unstable operation and lowered reliability in quality. To overcome the high amount of heat produced during the operation thereof, the electronic devices usually include a centrifugal fan as a heat dissipation device to achieve forced heat dissipation effect. However, the air volume produced by one single centrifugal fan has only limited effect in terms of forced heat dissipation effect. Under this circumstance, a dual centrifugal fan structure has been developed in an attempt to solve the heat dissipation problem in the electronic devices having very limited internal space.

FIGS. 1A, 1B and 1C show a conventional dual centrifugal fan structure 1, which includes a larger fan 10 and a smaller fan 12 located on a top of the larger fan 10. The larger fan 10 has a first air inlet 101, a first air outlet 102 and a first fan wheel 103. The first air inlet 101 is arranged on a bottom of the larger fan 10, and a larger receiving space 105 is defined in the larger fan 10 between the first air inlet 101 and the first air outlet 102 for accommodating the first fan wheel 103. The larger fan 10 is internally provided at a center of the top with a first bearing cup 107 and a first silicon steel plate assembly 108 is fitted around the first bearing cup 107, such that the first fan wheel 103 is rotatably connected to the first bearing cup 107 while encloses the first silicon steel plate assembly 108 therein.

On the other hand, the smaller fan 12 is provided on an outer side with a plurality of spaced lugs 121. The lugs 121 respectively have a through hole 1211 formed thereon and are located corresponding to a plurality of locking holes 109 formed on the top of the larger fan 10. By extending fastening elements 14, such as screws, through the through holes 1211 and the locking holes 109, the smaller fan 12 is fixedly connected to the top of the larger fan 10. The smaller fan 12 has a second air inlet 122, a second air outlet 123 and a second fan wheel 124. The second air inlet 122 is arranged on a top of the smaller fan 12, and the second air outlet 123 defines an air out direction opposite to that of the first air outlet 102. A smaller receiving space 126 is defined in the smaller fan 12 between the second air inlet 122 and the second air outlet 123 for accommodating the second fan wheel 124 therein.

The smaller fan 12 is provided on a center of a bottom thereof with a second bearing cup 127, and a second silicon steel plate assembly 128 is fitted around the second bearing cup 127. The second fan wheel 124 is rotatably connected to the second bearing cup 127 while encloses the second silicon steel plate assembly 128 therein. When the first and the second air outlet 102, 123 of the larger and the smaller fan 10, 12, respectively, guide airflows toward heat-producing elements in the electronic device, such as a notebook computer, the dual centrifugal fan structure 1 can produce increased total air volume to achieve forced heat dissipation effect.

While the conventional dual centrifugal fan structure 1 can produce increased total air volume, the actual amount of the air volume increased is limited. Further, the conventional dual centrifugal fan structure 1 causes another problem. That is, the first fan wheel 103 of the larger fan 10 has blades extended in directions different from those of the blades on the second fan wheel 124 of the smaller fan 12, and part of the airflows guided out of the second air outlet 123 of the smaller fan 12 and out of the first air outlet 102 of the larger fan 10 would interfere with or collide with each other around the larger and the smaller fan 10, 12 to produce eddies, as shown in FIG. 1C. Therefore, the flow field around the dual centrifugal fan structure 1 is unsmooth to adversely affect the overall performance of the dual centrifugal fan structure 1.

Moreover, in manufacturing and assembling the dual centrifugal fan structure 1, increased manufacturing and assembling costs are required because the smaller fan 12 is locked to the top of the larger fan 10 with a plurality of fastening elements 14 to consume extra labor and time. Further, the larger and the smaller fan 10, 12 are two independent centrifugal fans, they respectively include a circuit board for controlling the fan wheel thereof, i.e. the first fan wheel 103 and the second fan wheel 124 are separately controlled via two independent circuit boards. As a result, the fan wheels of the larger and the smaller fan 10, 12 are not consistent in their rotating speeds and require two different power supplies to consume more power and further increase the use cost of the dual centrifugal fan structure 1.

In brief, the conventional dual centrifugal fan structure has the following disadvantages: (1) unsmooth flow field that prevents the fan structure from having improved total performance; (2) increased assembling labor and time costs and power consumption; and (3) increased manufacturing and use costs.

It is therefore desirable to work out a way for overcoming the problems and disadvantages in the conventional dual centrifugal fan structure.

SUMMARY OF THE INVENTION

A primary object of the present invention is to effectively solve the problems in the conventional dual centrifugal fan structure by providing a novel fan blade system with multiple spaced layers of blades, which enables a fan using same to have upgraded performance.

Another object of the present invention is to provide a fan blade system with multiple spaced layers of blades, which can be manufactured with reduced labor, time and material costs and requires only reduced power consumption.

A further object of the present invention is to provide a centrifugal fan that has upgraded overall performance.

A still object of the present invention is to provide a centrifugal fan that can be manufactured with reduced labor, time and material costs and requires only reduced power consumption.

To achieve the above and other objects, the fan blade system with multiple spaced layers of blades according to a preferred embodiment of the present invention includes a hub, a first blade group, and a second blade group. The hub has a top and a circumferential wall. The circumferential wall has a first end axially extended from a periphery of the top by a predetermined length to an opposite second end, and is axially divided into at least a first extension zone and at least a second extension zone located adjoining the first end and the second end of the circumferential wall, respectively. The first blade group includes a plurality of first blades outward extended from the first extension zone of the circumferential wall, and the second blade group includes a plurality of second blades outward extended from the second extension zone of the circumferential wall. And, the first blade group is axially spaced from the second blade group, and the first blades and the second blades are arranged in a staggered relation to one another. With this structural design, a centrifugal fan using the fan blade system of the present invention can have effectively upgraded overall performance and can be manufactured with reduced labor, time and material costs while requiring only reduced power consumption during operation thereof.

To achieve the above and other objects, the centrifugal fan according to a preferred embodiment of the present invention includes a housing and a fan blade system with multiple spaced layers of blades. The housing includes a main housing portion, a secondary housing portion located at a top side of the main housing portion, and at least one separating plate. The main housing portion has a first air inlet, a first air outlet and an intermediate opening formed between the main housing portion and the secondary housing portion to face toward the first air inlet, and internally defines a main receiving space between the first air inlet and the first air outlet. The separating plate is connected to one side of the intermediate opening to locate in the main receiving space, and has a central opening communicating with the intermediate opening. The secondary housing portion has a second air inlet and a second air outlet, and internally defines a secondary receiving space between the second air inlet and the second air outlet. One side of the secondary receiving space is a first open side corresponding to the intermediate opening, allowing the secondary receiving space to communicate with the main receiving space.

The fan blade system with multiple spaced layers is accommodated in the housing, and includes a hub, a first blade group, and a second blade group. The hub has a top and a circumferential wall. The circumferential wall has a first end axially extended from a periphery of the top by a predetermined length to an opposite second end and is axially divided into at least a first extension zone and at least a second extension zone located adjoining the first end and the second end of the circumferential wall, respectively. The first blade group includes a plurality of first blades outward extended from the first extension zone of the circumferential wall, and the second blade group includes a plurality of second blades outward extended from the second extension zone of the circumferential wall. And, the first blade group is axially spaced from the second blade group; the first blades and the second blades are arranged in a staggered relation to one another. When the fan blade system is mounted in the housing, the first and the second blade group are separately received in the secondary and the main receiving space, and are isolated from one another by the separating plate. With this structural design, a smoother flow field around the centrifugal fan can be formed to increase the airflow pressure and the air volume that can be produced by the centrifugal fan; and the centrifugal fan can be manufactured with reduced labor, time and material costs while requiring only reduced power consumption during operation thereof.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with some preferred embodiments thereof and with reference to the accompanying drawings.

Figure 1A:
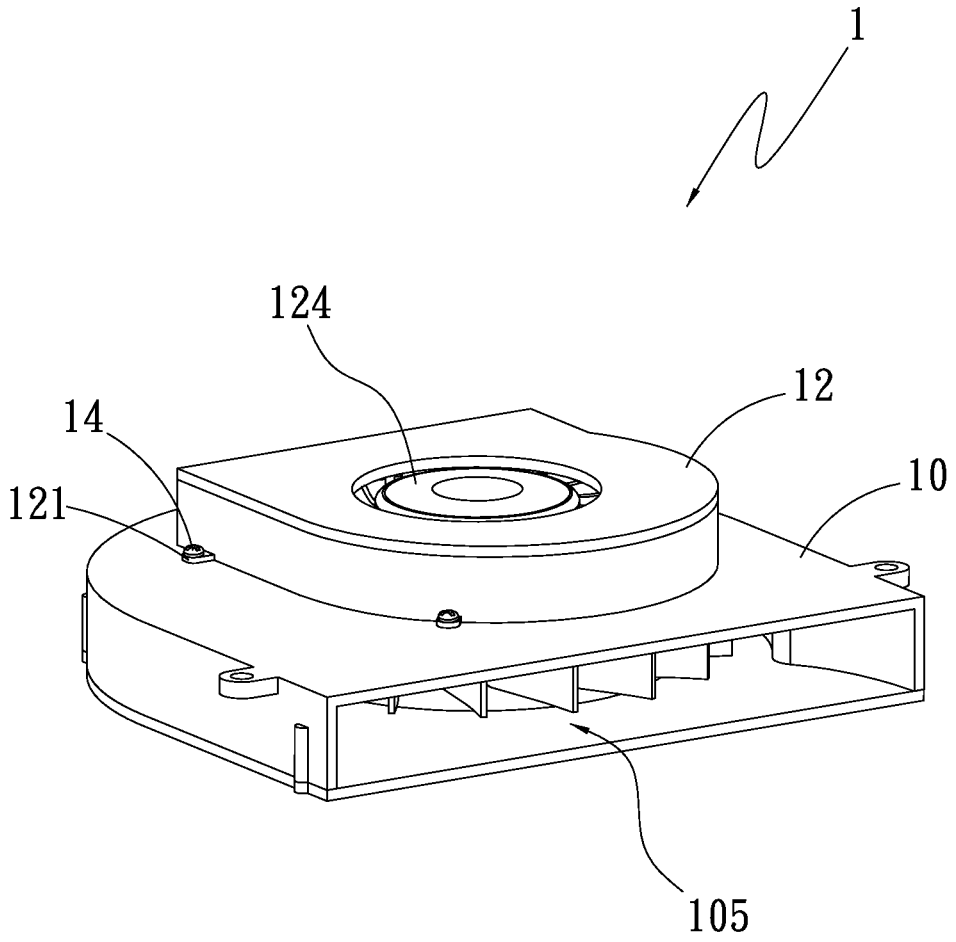
(PRIOR ART) Fig. 1A
FIG. 1A is an assembled perspective view of a conventional dual centrifugal fan structure.
Figure 1B:
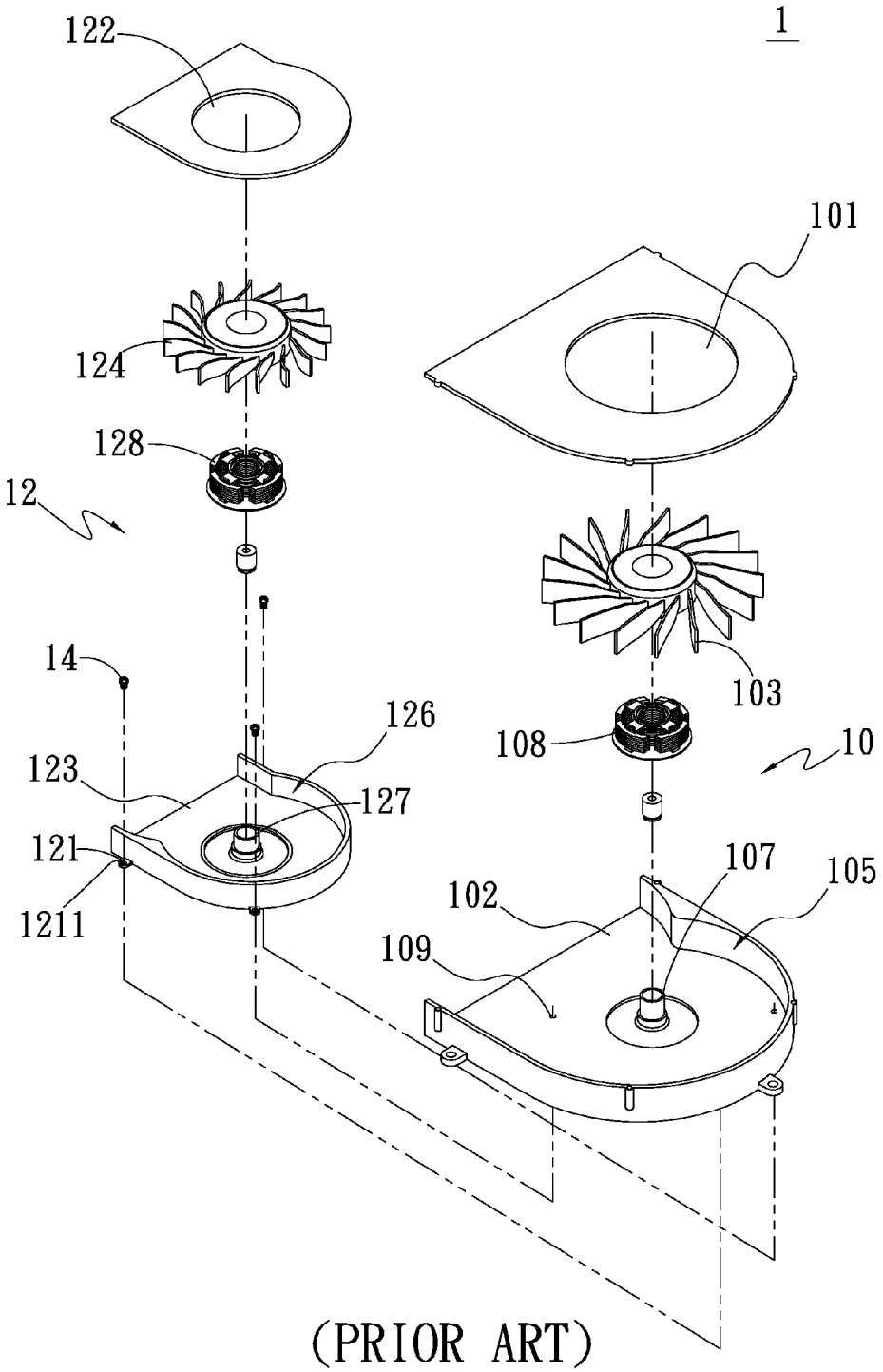
(PRIOR ART) Fig. 1B
FIG. 1B is an exploded view of FIG. 1A.
Figure 1C:
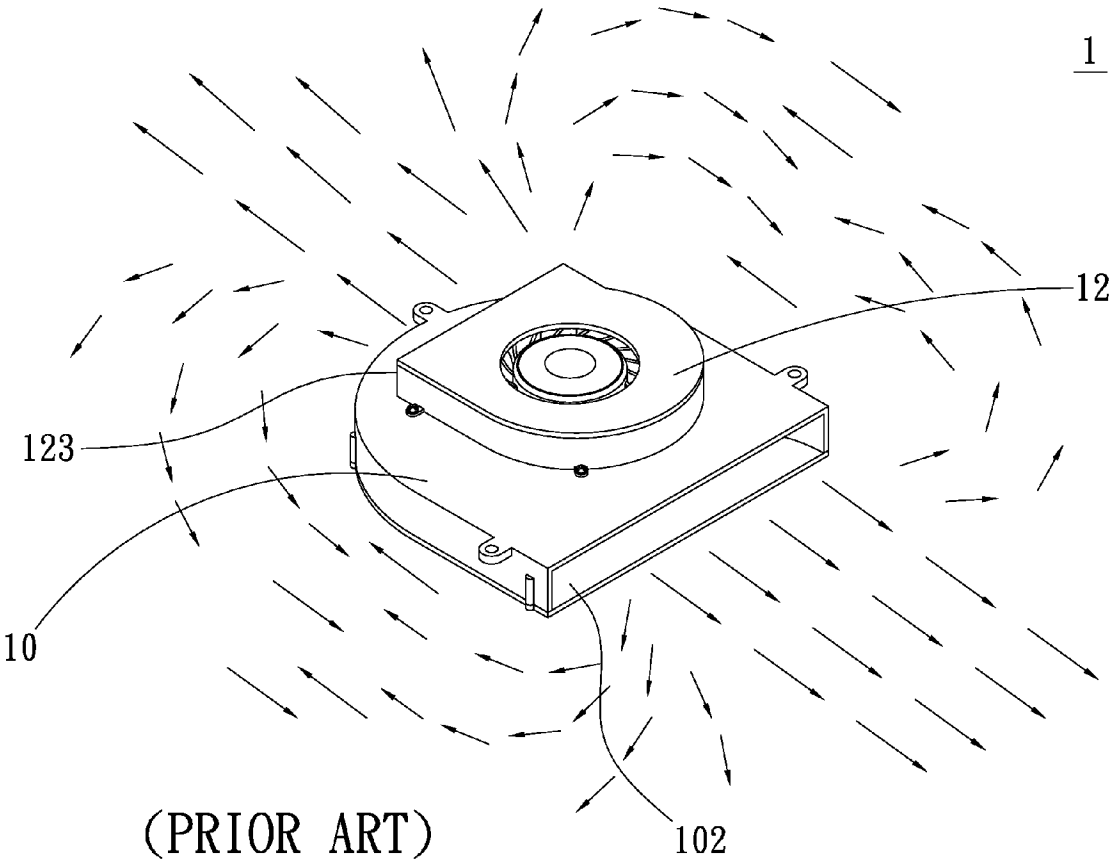
(PRIOR ART) Fig. 1C
FIG. 1C shows air flows produced by the conventional dual centrifugal fan structure of FIG. 1A during operation thereof.
Figure 2:
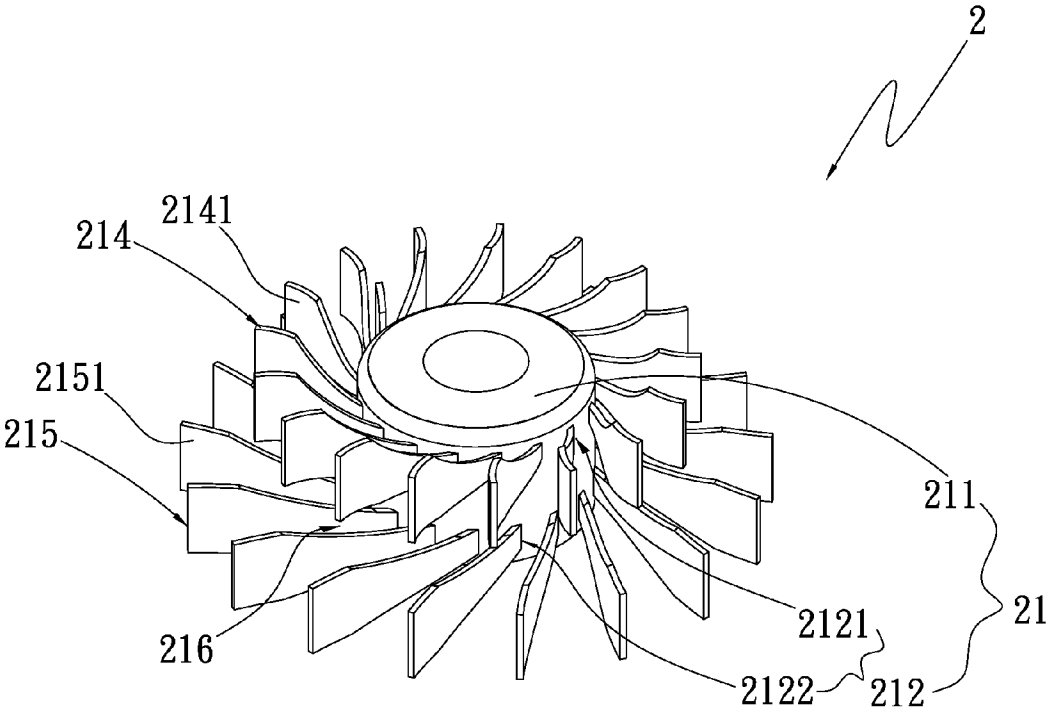
FIG. 2 is a perspective view of a fan blade system with multiple spaced layers of blades according to a first preferred embodiment of the present invention.

Please refer to FIG. 2 that is a perspective view of a fan blade system with multiple spaced layers of blades according to a first preferred embodiment of the present invention. For the purpose of conciseness, the first preferred embodiment of the present invention is also briefly referred to as "the fan blade system" and generally denoted by reference numeral 2 herein. As shown, the fan blade system 2 includes a hub 21, a first blade group 214, and a second blade group 215. The hub 21 includes a top 211 and a circumferential wall 212 having a first end axially extended from a periphery of the top 211 by a predetermined length to an opposite second end of the circumferential wall 212. The circumferential wall 212 is axially divided into at least a first extension zone 2121 and at least a second extension zone 2122. In the illustrated first preferred embodiment, one first extension zone 2121 and one second extension zone 2122 are shown to locate adjoining the first end and the second end of the circumferential wall 212, respectively.

The first blade group 214 includes a plurality of first blades 2141 outward extended from the first extension zone 2121 of the circumferential wall 212. That is, the first blades 2141 together form a first layer of blades around the circumferential wall 212 closer to the first end thereof. The second blade group 215 includes a plurality of second blades 2151 outward extended from the second extension zone 2122 of the circumferential wall 212. That is, the second blades 2151 together form a second layer of blades around the circumferential wall 212 closer to the second end thereof, and the second layer of blades is adjacent to the first layer of blades. Therefore, two layers of blades are formed around the circumferential wall 212 of the hub 21.

While the first preferred embodiment of the present invention is described with two layers of blades formed around the circumferential wall 212, it is understood the first preferred embodiment is only illustrative and not intended to restrict the present invention in any way. In practical implementation of the present invention, three, four or more layers of blades may be formed around the circumferential wall 212 of the hub 21, depending on the required airflow pressure and air volume to be produced by the fan.

Figure 3A:
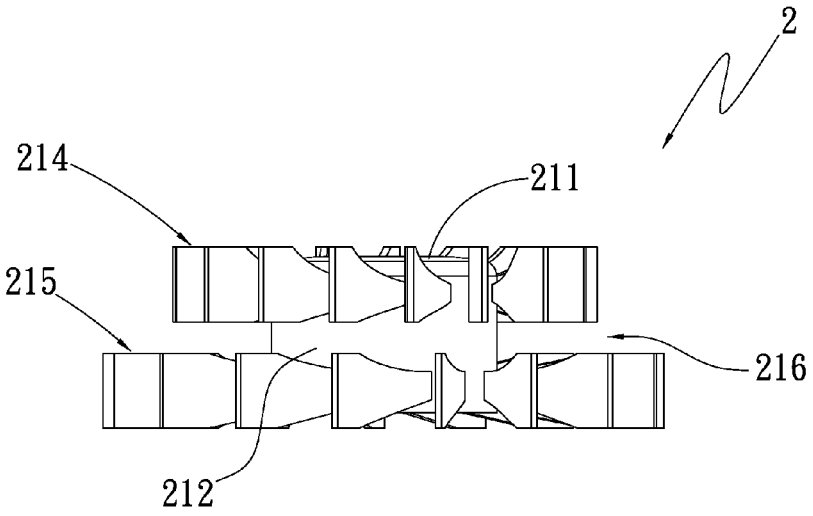
FIG. 3A is a side view of FIG. 2.
Figure 3B:
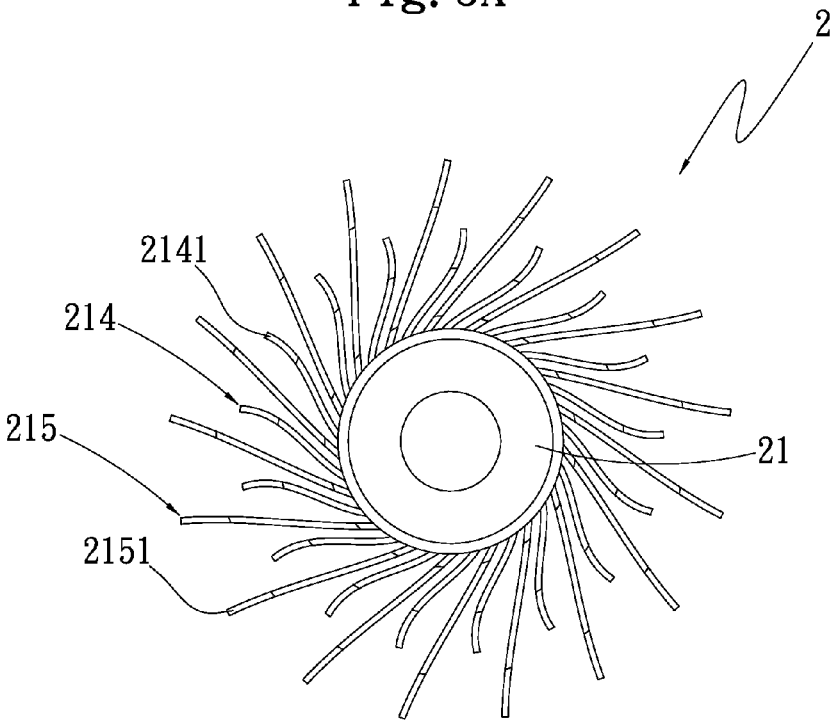
FIG. 3B is a top view of FIG. 2.

FIGS. 3A and 3B are side and top views, respectively, of the fan blade system 2. Please refer to FIG. 2 along with FIGS. 3A and 3B. The first blades 2141 in the first layer of blade and the second blades 2151 in the second layer of blades are arranged in a staggered relation to one another while they are outward extended from the circumferential wall 212 in the same direction. In the illustrated first preferred embodiment, the first blades 2141 have a length smaller than that of the second blades 2151. However, it is understood the first preferred embodiment is only illustrative and not intended to restrict the present invention in any way. In practical implementation of the present invention, the first blades 2141 may have a length larger than or equal to that of the second blades 2151. It is noted a separating space 216 is left between the first blade group 214 and the second blade group 215 for spacing the first blades 2141 from the second blades 2151.

The fan blade system 2 according to the present invention is able to produce effectively increased airflow pressure and air volume, and can therefore upgrade the performance of a centrifugal fan using same.

Further, by forming multiple spaced layers of blades 2141, 2151 around the hub 21 and arranging the blades 2141, 2151 in different layers in a staggered relation to one another, mold separation can be more quickly and conveniently done in manufacturing the fan blade system 2 to thereby effectively save labor and time to reduce the manufacturing cost of the present invention.

Figure 4:
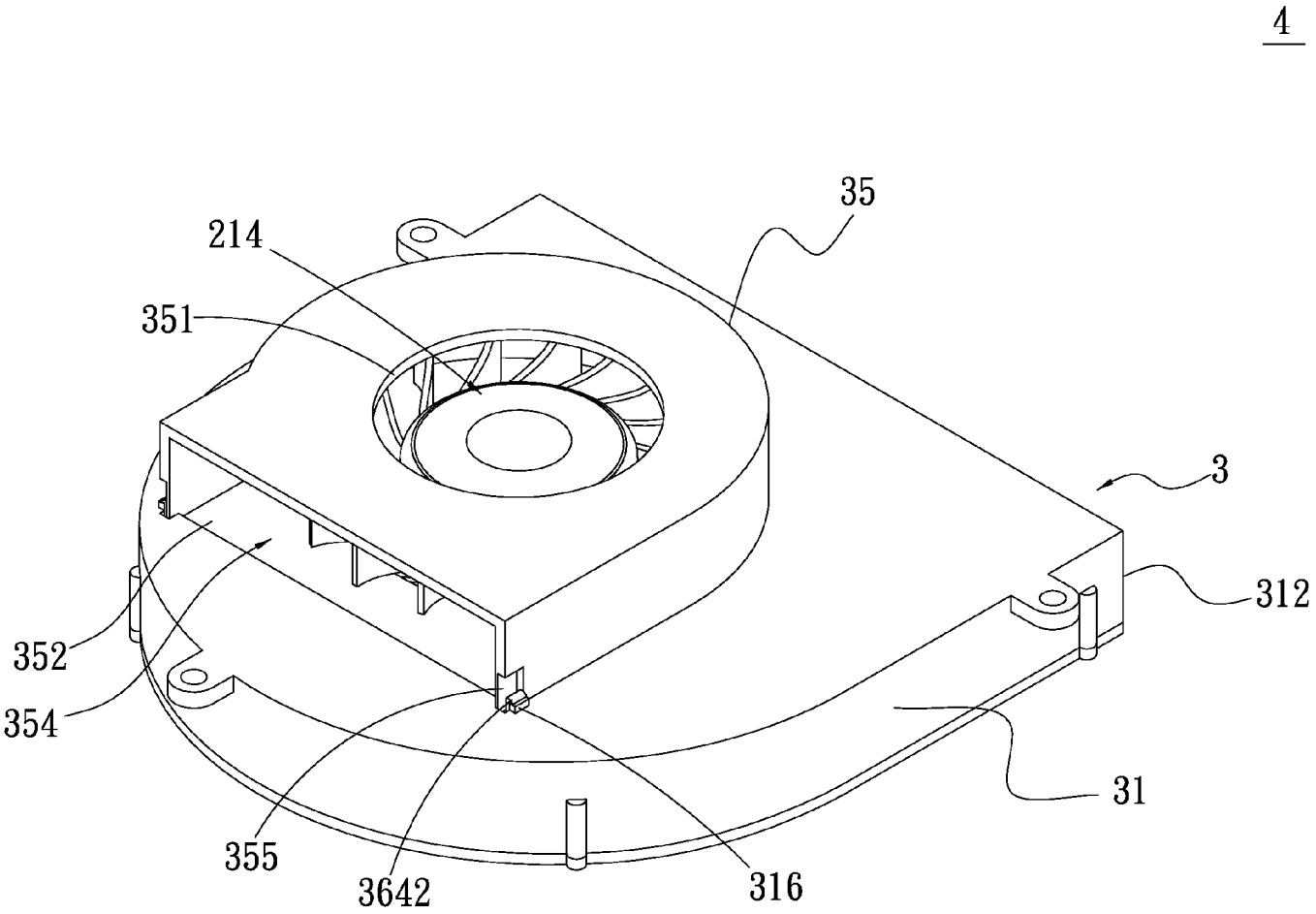
FIG. 4 is an assembled top perspective view of a centrifugal fan according to a second preferred embodiment of the present invention that includes a fan blade system with multiple spaced layers of blades according to the first preferred embodiment of the present invention.
Figure 5:
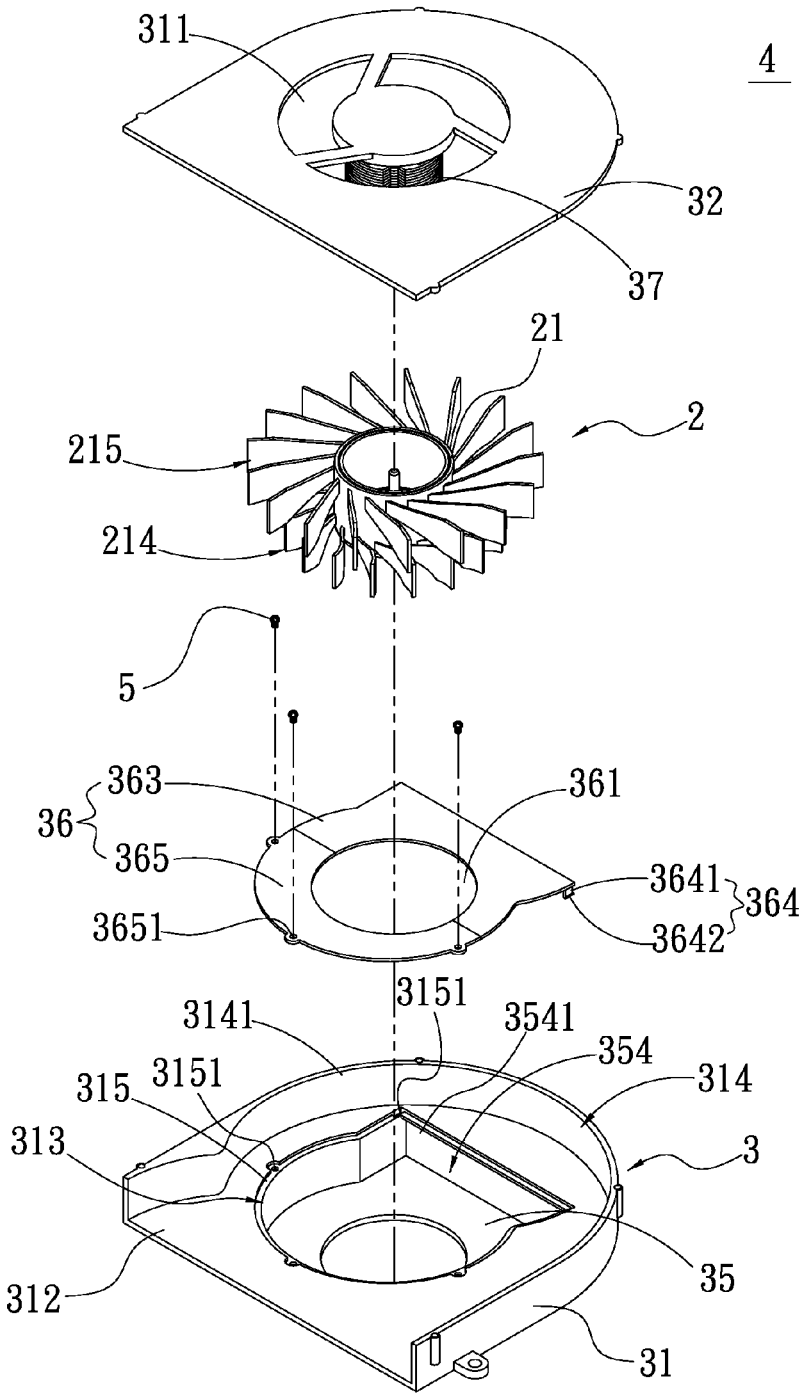
FIG. 5 is an exploded bottom perspective view of the centrifugal fan of FIG. 4.
Figure 6:
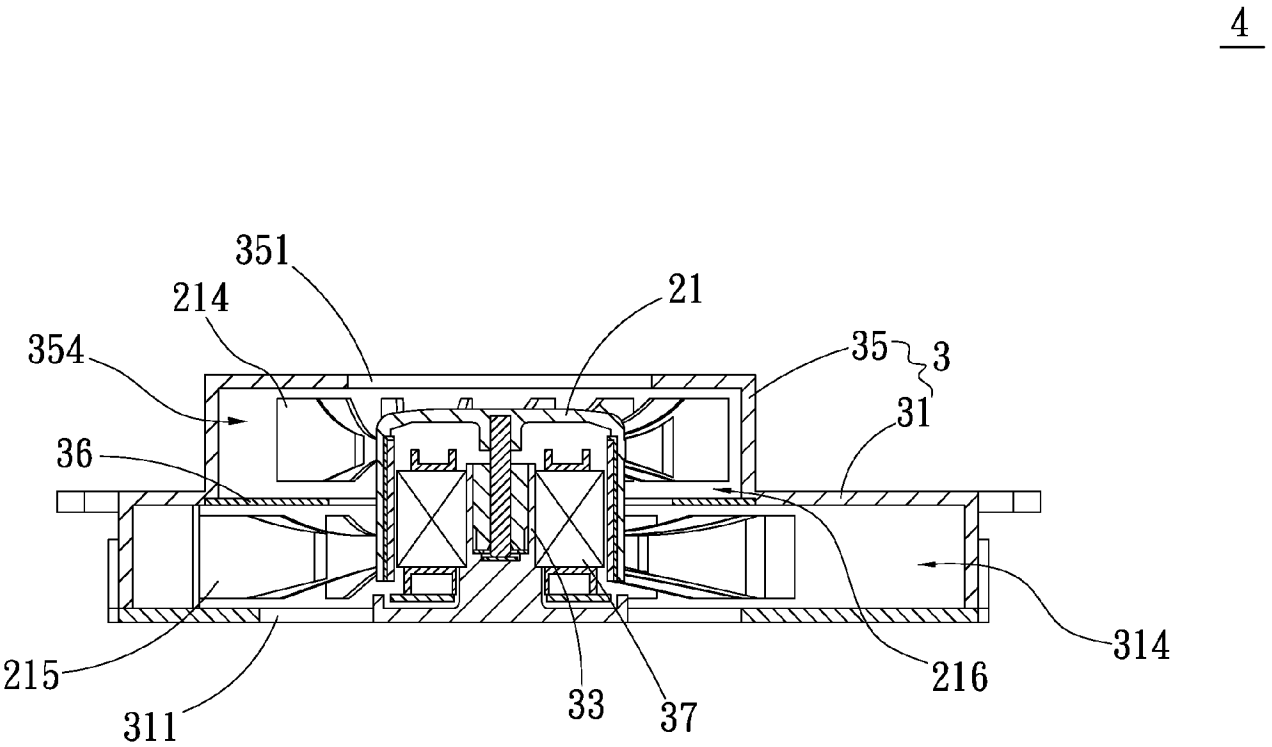
FIG. 6 is a cross sectional view of FIG. 4.

FIG. 4 is an assembled perspective view of a centrifugal fan 4 according to a second preferred embodiment of the present invention, FIG. 5 is an exploded bottom perspective view of FIG. 4, and FIG. 6 is a cross sectional view of FIG. 4. Please refer to FIGS. 4, 5 and 6 along with FIG. 2. The centrifugal fan 4 employs the fan blade system 2 according to the first preferred embodiment of the present invention. That is, the centrifugal fan 4 includes a housing 3 and a fan blade system 2 with multiple spaced layers of blades. Since the fan blade system 2 in the second preferred embodiment is structurally and functionally similar to that in the first preferred embodiment, it is not repeatedly described in details herein.

The housing 3 includes a main housing portion 31, a secondary housing portion 35, which is located above the main housing portion 31 in the illustrated second preferred embodiment, and at least one separating plate 36. The main housing portion 31 has a first air inlet 311, a first air outlet 312, an intermediate opening 313, a groove 315, and a bottom cover 32. The main housing portion 31 internally defines a main receiving space 314 between the first air inlet 311 and the first air outlet 312 for accommodating the second blade group 215 of the fan blade system 2 therein. The main receiving space 314 has a second open side 3141 communicating with the intermediate opening 313. The bottom cover 32 is detachably closed to the second open side 3141. As can be seen in FIG. 6, a bearing cup 33 is forward projected from an inner side of the bottom cover 32 into the main receiving space 314, and a silicon steel plate assembly 37 is externally fitted around the bearing cup 33. The hub 21 of the fan blade system 2 is rotatably connected to the bearing cup 33 and encloses the silicon steel plate assembly 37 therein. The first air inlet 311 is formed on the bottom cover 32 to locate around and adjacent to the bearing cup 33, and is located opposite to the intermediate opening 313.

The groove 315 is formed on a top inner surface of the main housing portion 31 facing away from the secondary housing portion 35 to extend along a border of the intermediate opening 313. The separating plate 36 is connected to the top inner surface of the main housing portion at the groove 315 to locate immediately below the intermediate opening 315. In other words, the intermediate opening 313 extends through the top of the main housing portion 31 to face toward and communicate with the secondary housing portion 35; and the separating plate 36 is located in the main receiving space 314 below the intermediate opening 313 and connected to the main housing portion 31 along the groove 315, so as to shield a part of the intermediate opening 313.

As can be seen in FIGS. 5 and 6, the groove 315 has a plurality of through holes 3151 formed therein to locate on and space along a bottom thereof. The separating plate 36 has a central opening 361, a first separating plate part 363, and a second separating plate part 365. The central opening 361 communicates with the intermediate opening 313 and the main receiving space 314. The first separating plate part 363 is connected to a portion of the groove 315 that is located farther from the first air outlet 312 of the main housing portion 31, and the second separating plate part 365 is connected to another portion of the groove 315 that is located closer to the first outlet 312, such that the first separating plate part 363 and the second separating plate part 365 are located end to end below the intermediate opening 313.

It is noted that, when the fan blade system 2 is mounted in the housing 3, the first separating plate part 363 and the second separating plate part 365 are located in around the separating space 216 at two diametrically opposite sides thereof, such that the central opening 361 defined by between the first and second separating plate parts 363, 365 is externally closely located around the circumferential wall 212 of the hub 21 to isolate the second blade group 215 located in the main receiving space 314 from the first blade group 214, which is located in a secondary receiving space 354 defined in the secondary housing portion 35.

The first separating plate part 363 has a plurality of retaining elements 364 provided at two corners of an edge thereof facing away from the second separating plate part 365. Each of the retaining elements 364 includes an extension section 3641 and a hook section 3642 outward projected from a distal end of the extension section 3641 opposite to the first separating plate part 363.

The second separating plate part 365 has a plurality of fixing holes 3651 spaced along an edge thereof facing away from the first separating plate part 363. The fixing holes 3651 are communicable with some of the through holes 3151 that are located corresponding thereto. By extending a plurality of fastening elements 5, such as screws or rivets, through the fixing holes 3651 into the corresponding through holes 3151, the second separating plate part 365 can be fixedly fastened to the main housing portion 31 at the groove 315.

Please refer to FIGS. 4 and 5 along with FIGS. 2 and 3. The secondary housing portion 35 is located on one side of the main housing portion 31. In the illustrated second preferred embodiment of the present invention, the secondary housing portion 35 is located on the top side of the main housing portion 31. That is, the secondary housing portion 35 is upward extended from one side of the main housing portion 31 having the intermediate opening 313 formed thereon. Further, the secondary housing portion 35 is integrally formed with the main housing portion 31. The secondary housing portion 35 has a second air inlet 351 and a second air outlet 352. The above-mentioned secondary receiving space 354 is defined in the secondary housing portion 35 between the second air inlet 351 and the second air outlet 352 and is communicable with the main receiving space 314 in the main housing portion 31.

The secondary receiving space 354 has a first open side 3541 facing toward the separating plate 36 and communicating with the intermediate opening 313, and the secondary receiving space 354 is configured for accommodating the first blade group 214 of the fan blade system 2 therein.

As can be most clearly seen in FIG. 4, the secondary housing portion 35 is provided on two opposite lateral outer sides near the second air outlet 352 with a plurality of recesses 355 corresponding to the extension sections 3641 of the retaining elements 364 formed on the first separating plate part 363, such that the extension sections 3641 can be extended through the corresponding through holes 3151 into the recesses 355, allowing the hook sections 3642 at the distal ends of the extension sections 3641 to engage with protrusions 316 formed on an outer surface of the top side of the main housing portion 31 and thereby hold the first separating plate part 363 in place in the main receiving space 314.

In the second preferred embodiment of the present invention, airflows blowing from the first air outlet 312 and from the second air outlet 352 are directed to two opposite directions, and the first air outlet 312 has dimensions larger than those of the second air outlet 352. However, it is understood the second preferred embodiment is only illustrative and not intended to restrict the present invention in any way. That is, the first air outlet 312 and the second air outlet 352 may be designed to blow airflows toward the same direction, and the first air outlet 312 may have dimensions smaller than or equal to those of the second air outlet 352.

Figure 7:
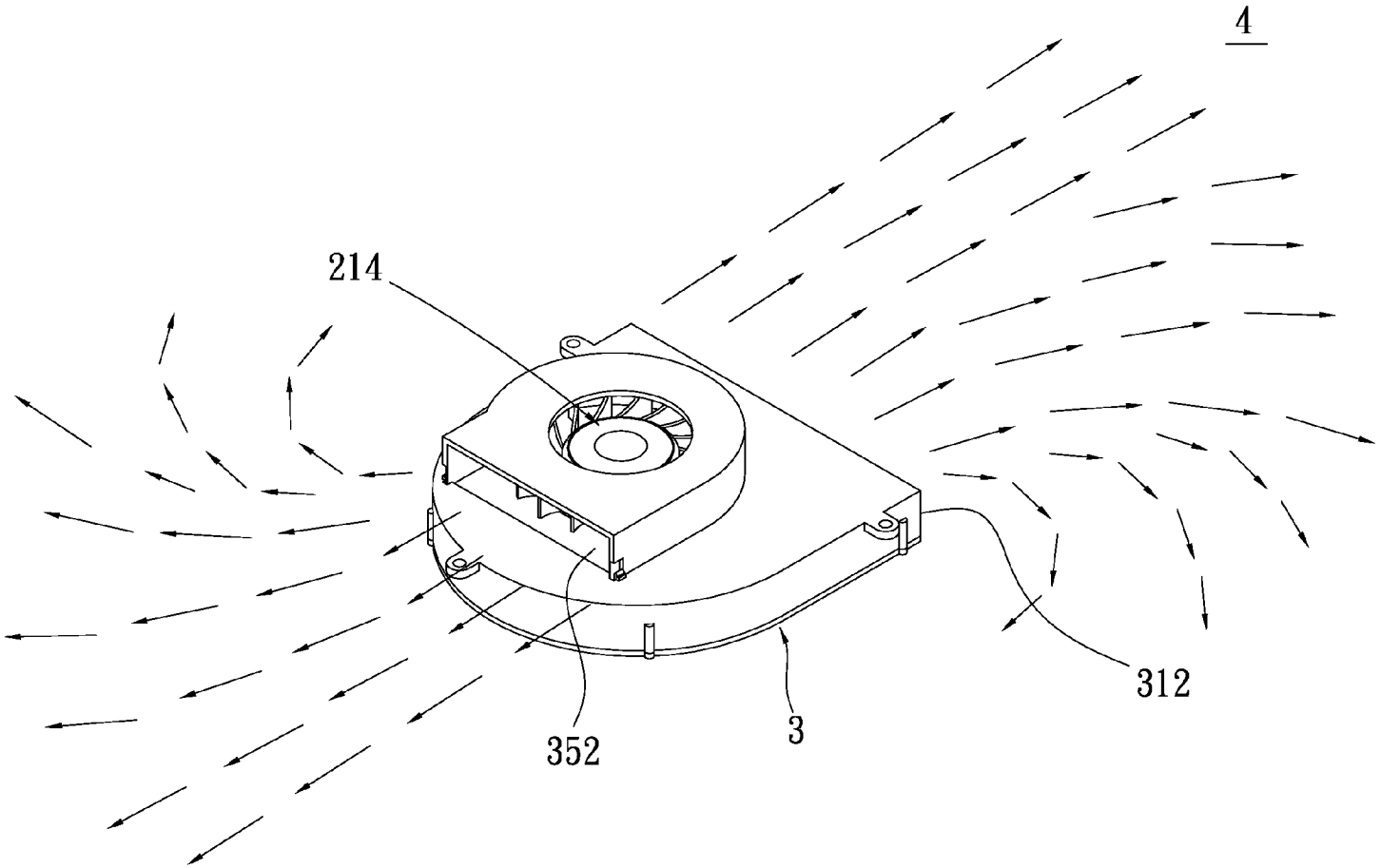
FIG. 7 shows air flows produced by the centrifugal fan according to the second embodiment of the present invention during operation thereof.

Since the first blades 2141 in the first blade group 214 and the second blades 2151 in the second blade group 215 are extended in the same direction, airflows blowing out of the first air outlet 312 and distributing around the main housing portion 31 and airflows blowing out of the second air outlet 352 and distributing around the secondary housing portion 35 would not interfere with one another, as shown in FIG. 7. In this manner, a smoother flow field around the centrifugal fan 4 can be effectively achieved to significantly improve the problem of eddies occurred in using the conventional dual centrifugal fan structure. Therefore, it is able to ensure an enhanced overall performance of the centrifugal fan 4.

When the centrifugal fan 4 operates, the first air inlet 311 of the main housing portion 31 and the second air inlet 351 of the secondary housing portion 35 respectively guide external airflows into the main receiving space 314 and the secondary receiving space 354 at the same time. The first blade group 214 and the second blade group 215 respectively increase the pressure of airflows in the secondary receiving space 354 and the main receiving space 314; and the pressurized airflows are then guided out of the secondary housing portion 35 and the main housing portion 31 via the second air outlet 352 and the first air outlet 312, respectively, to blow against heat-producing elements, such as a central processing unit (CPU), a south and north bridge chipset or a display card chip, in an electronic product, such as a notebook computer, to achieve forced heat dissipation effect by providing doubled air volume. The centrifugal fan 4 having the above-described structure also enables increased overall airflow pressure and air volume.

According to the design of the centrifugal fan 4, only one single hub 21 is needed to rotate both the first and the second blade group 214, 215 while doubled air volume can be produced. Therefore, the overall performance of the centrifugal fan 4 is effectively upgraded while the power consumption thereof is reduced. In manufacturing and assembling the centrifugal fan 4, since two or more spaced layers of blades, for example, the first and the second blade group 214, 215, are formed on one hub 21, labor and time as well as material for internal fan parts all can be reduced to save a lot of manufacturing costs of the centrifugal fan 4. Compared to the conventional dual centrifugal fan structure, the present invention saves the material costs for at least one circuit board, one silicon-steel plate assembly and one hub.

In brief, the present invention has the following advantages: (1) upgraded overall centrifugal fan performance; (2) reduced material costs; and (3) reduced labor and time costs as well as lowered power consumption.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A centrifugal fan, comprising:

a housing including a main housing portion, a secondary housing portion located at one side of the main housing portion, and at least one separating plate;

the main housing portion having a first air inlet, a first air outlet and an intermediate opening formed between the main housing portion and the secondary housing portion to face toward the first air inlet, and internally defining a main receiving space between the first air inlet and the first air outlet;

the separating plate being connected to one side of the intermediate opening to locate in the main receiving space, and having a central opening communicable with the intermediate opening; and the secondary housing portion having a second air inlet and a second air outlet, and internally defining a secondary receiving space between the second air inlet and the second air outlet; one side of the secondary receiving space being a first open side corresponding to the intermediate opening, allowing the secondary receiving space to communicate with the main receiving space; and a fan blade system having multiple spaced layers of blades and being mounted in the housing; the fan blade system including a hub, a first blade group, and a second blade group;

the hub having a top and a circumferential wall; the circumferential wall having a first end axially extended from a periphery of the top by a predetermined length to an opposite second end, and being axially divided into at least a first extension zone and at least a second extension zone located adjoining the first end and the second end of the circumferential wall, respectively;

the first blade group including a plurality of first blades outward extended from the first extension zone of the circumferential wall; and the second blade group including a plurality of second blades outward extended from the second extension zone of the circumferential wall; and the second blade group being located adjacent to the first blade group; and wherein the first and the second blade group are accommodated in the secondary receiving space and the main receiving space, respectively, and are isolated from each other by the separating plate.

2. The centrifugal fan as claimed in claim 1, wherein the main housing portion further has a groove formed on an inner surface of the main housing portion facing away from the secondary housing portion to extend along a border of the intermediate opening; and the separating plate being connected to one side of the intermediate opening at the groove to locate in the main receiving space of the main housing portion.

3. The centrifugal fan as claimed in claim 2, wherein the groove has a plurality of through holes formed therein to locate on and space along a bottom of the groove.

4. The centrifugal fan as claimed in claim 3, wherein the secondary housing portion is provided on two opposite lateral outer sides near the second air outlet with a plurality of recesses, and the recesses being communicable with some of the through holes in the groove that are located corresponding to the recesses.

5. The centrifugal fan as claimed in claim 4, wherein the separating plate includes a first separating plate part and a second separating plate part located end to end to together define the central opening therebetween; the first separating plate part having a plurality of retaining elements provided at two corners of an edge thereof facing away from the second separating plate part, each of the retaining elements including an extension section and a hook section outward projected from a distal end of the extension section; the extension sections being extended into the recesses via the through holes that are located corresponding to the recesses, such that the hook sections are engaged with protrusions externally formed on the main housing portion to thereby hold the first separating plate part in place in the main receiving space.

6. The centrifugal fan as claimed in claim 5, wherein the second separating plate part has a plurality of fixing holes spaced along an edge thereof facing away from the first separating plate part; the fixing holes being communicable with some of the through holes in the groove that are located corresponding to the fixing holes, such that a plurality of fastening elements can be extended through the fixing holes into the corresponding through holes to thereby hold the second separating plate part in place in the main receiving space.

7. The centrifugal fan as claimed in claim 1, wherein the main receiving space has a second open side communicating with the intermediate opening; and wherein the main housing portion further has a bottom cover detachably closed to the second open side, and a bearing cup forward projected from an inner side of the bottom cover into the main receiving space; the hub of the fan blade system being rotatably connected to the bearing cup, and the first air inlet being formed on the bottom cover to locate around and adjacent to the bearing cup.

8. The centrifugal fan as claimed in claim 1, wherein the first air outlet and the second air outlet can be oppositely oriented or identically oriented for directing airflows produced by the fan blade system to two opposite directions or to the same direction.

9. The centrifugal fan as claimed in claim 1, wherein the first air outlet has dimensions smaller than those of the second air outlet.

10. The centrifugal fan as claimed in claim 1, wherein the first air outlet has dimensions larger than or equal to those of the second air outlet.

11. The centrifugal fan as claimed in claim 1, wherein the first blades in the first blade group and the second blades in the second blade group are arranged in a staggered relation to one another while they are outward extended from the circumferential wall in the same direction.

12. The centrifugal fan as claimed in claim 5, wherein the first blade group and the adjacent second blade group are spaced from each other by a separating space formed around the hub between the two blade groups; the first separating plate part and the second separating plate part being located in around the separating space at two diametrically opposite sides thereof, such that the central opening defined by between the first and second separating plate parts is externally closely located around the circumferential wall of the hub.

13. The centrifugal fan as claimed in claim 1, wherein the first blades have a length smaller than that of the second blades.

14. The centrifugal fan as claimed in claim 1, wherein the first blades have a length larger than or equal to that of the second blades.

15. The centrifugal fan as claimed in claim 1, wherein the main housing portion and the secondary housing portion are integrally formed with each other.

* * * * *